US005165132A

United States Patent [19]

Giorgio et al.

[11] Patent Number: 5,165,132

[45] Date of Patent: Nov. 24, 1992

[54] RECIPROCATING BRUSH

[75] Inventors: Gaiti Giorgio, Correggio; Ferrari Loris, Carpi, both of Italy

[73] Assignee: G.F. S.R.L., an Italian limited company, Correggio, Italy

[21] Appl. No.: 691,810

[22] Filed: Apr. 26, 1991

[30] Foreign Application Priority Data

May 4, 1990 [IT] Italy ..... 46834 A/90

[51] Int. Cl.[5] ..... A46B 13/06

[52] U.S. Cl. ..... 15/22.2; 15/22.1; 51/170 TL

[58] Field of Search ..... 15/22.1, 22.2, 22.4, 15/97.1, 52.2, 50.2; 51/170 TL, 175; 173/50, 51, 168, 169; 128/53

[56] References Cited

U.S. PATENT DOCUMENTS 1,761,059 6/1930 Van Norman et al. ..... 15/22.2
3,517,235 6/1970 Flowers et al. ..... 15/22.1
3,992,744 11/1976 Fassler ..... 15/22.1
4,458,676 7/1984 Pileggi ..... 15/97.1
4,891,857 1/1990 Pinsonneault .

FOREIGN PATENT DOCUMENTS 264744 5/1964 Australia ..... 15/22.1
2568120 6/1984 France .
1260000 9/1986 U.S.S.R. ..... 15/22.1

*Primary Examiner*—Edward L. Roberts

[57] ABSTRACT

A brush for general surface cleaning comprises a casing rotatably housing a bladed impeller (8) with which a nozzle (9) is tangentially associated for the entry of the wash water, which then flows towards a cleaning member comprising at least one slide block (3) positioned to close the lower aperture of the casing and lowerly provided with a mass of bristles (31), and linked to the impeller shaft (7) in such a manner as to be subjected to reciprocating rectilinear movement transversely to said shaft (7).

7 Claims, 3 Drawing Sheets

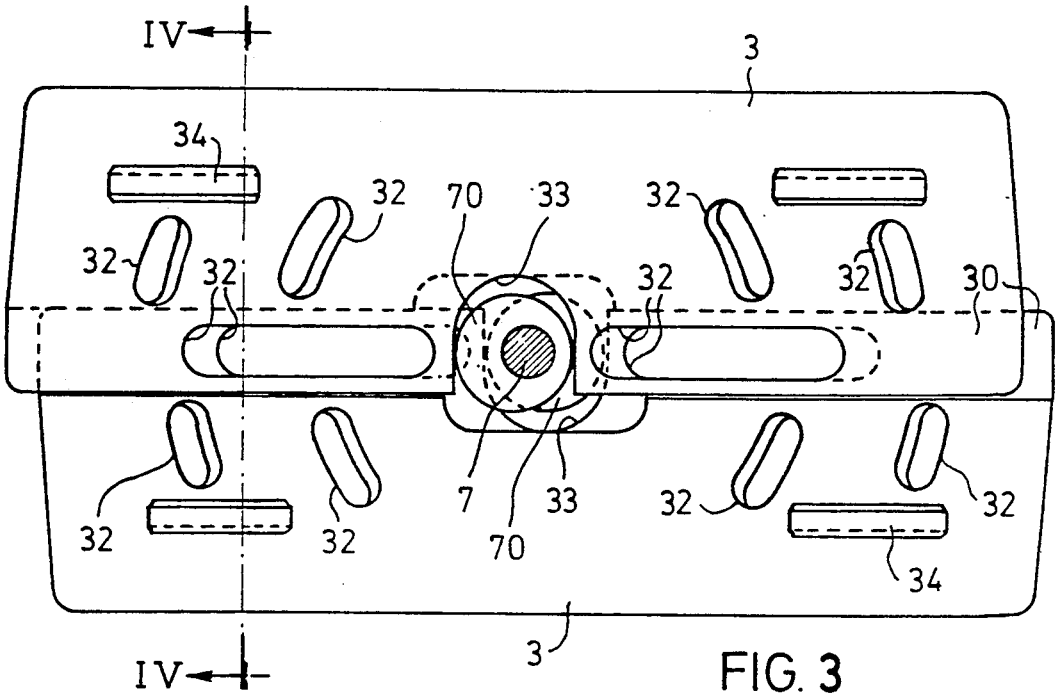
FIG. 3
FIG. 5
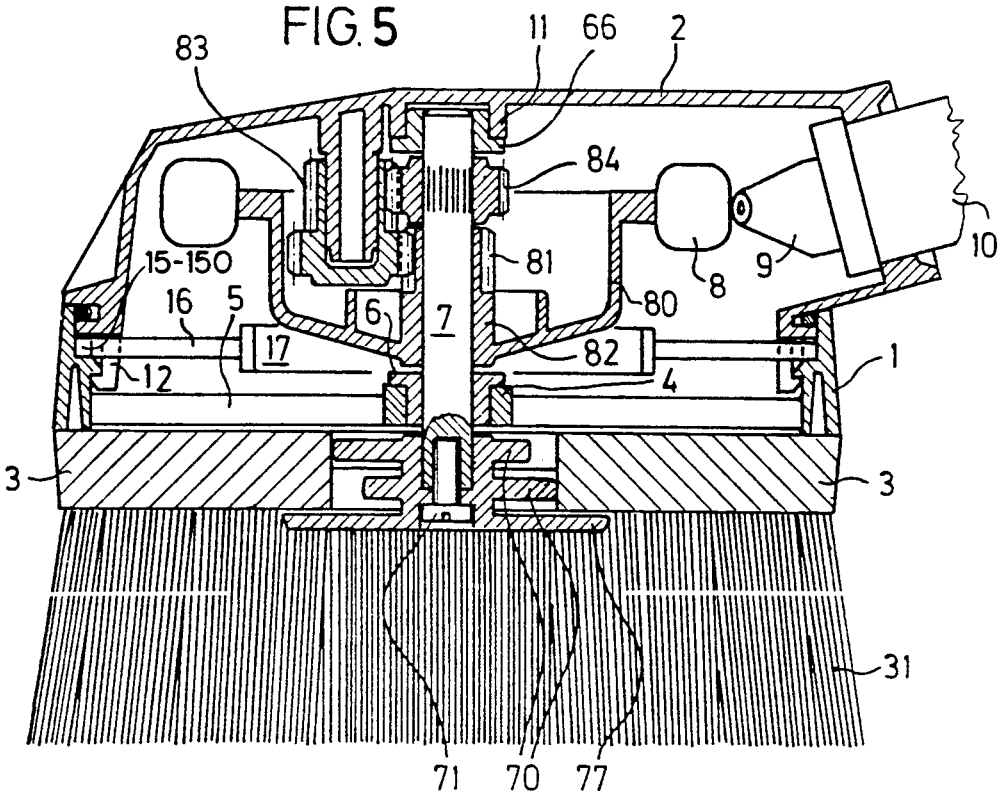

RECIPROCATING BRUSH

BACKGROUND OF THE INVENTION

This invention relates to a brush for general surface cleaning, of the type operated by the actual cleaning or wash water.

SUMMARY OF THE INVENTION

An object of the invention is to provide a brush operated by its wash water, with particularly high cleaning characteristics or capacity.

A further object is to provide a brush able to clean surfaces comprising relatively narrow under-surface regions or recesses, such as grooves or channels.

A further object is to provide a brush able to correctly clean regions in proximity to corners or edges, as in the case for example of vehicle window surfaces in general.

In this respect, such situations demonstrate the limits of the use of known cleaning devices comprising a flat discoidal or circular brush made to rotate about its axis by an encased impeller driven by the wash water.

Basically, although provided with flexible bristles and made to rotate, a brush of this type does not enable such known devices to clean to the desired extent those surfaces comprising relatively narrow channels and corner regions as stated in the introduction.

The present invention provides a cleaning brush which achieves the aforesaid objects within the context of a simple and rational design which is extremely versatile in use.

According to the invention the proposed brush is of the type comprising a casing housing an impeller with which a wash water entry nozzle is tangentially associated. At the base of the casing there is provided a cleaning member comprising at least one slide block arranged transversely to the impeller axis, which has a mass of cleaning bristles, and is linked to the impeller shaft in such a manner as to be subjected to reciprocating rectilinear movement transversely to said shaft.

This can be achieved by means of an eccentric-motion device such as a crank provided on said shaft and engaging a respective seat provided in said at least one slide block.

Said eccentric-motion device preferably consists of an off-centre disc driven by the impeller shaft, and in a preferred embodiment of the invention the cleaning member consists of two side-by-side or frontal coplanar slide blocks made to slide with reciprocating rectilinear motion in phase opposition.

It should be noted that this latter form of construction has the advantage, compared with the former, of being perfectly balanced with regard to the inertial forces due to said reciprocating motion, and being easier to use.

By virtue of the aforesaid means the invention is able to clean practically any type of surface, including surfaces comprising recesses with corners and relatively narrow grooves. This is because the slide blocks are of right angled and preferably rectangular shape in plan view, and are driven with reciprocating rectilinear motion.

Because of these characteristics the slide blocks can be arranged such that their bristles are able to act effectively also in particularly difficult regions such as the aforesaid.

In addition, according to a further characteristic of the invention, to facilitate correct positioning of the slide blocks and hence of the bristles relative to the regions to be cleaned, the casing containing the impeller can be orientated at will relative to its support member, such as a hollow handgrip through which the wash water is fed.

BRIEF DESCRIPTION OF THE DRAWINGS

The characteristics and constructional merits of the invention will be apparent from the detailed description, given with reference to the accompanying figures which illustrate two preferred embodiments thereof by way of non-limiting example.

FIG. 3 is a view from above of the pair of slide blocks which support the cleaning bristles.

FIG. 5 is a sectional view identical to FIG. 1 but showing a second embodiment of the invention.

DETAILED DESCRIPTION OF PREFERRED EMBODIMENT

Figure 1:
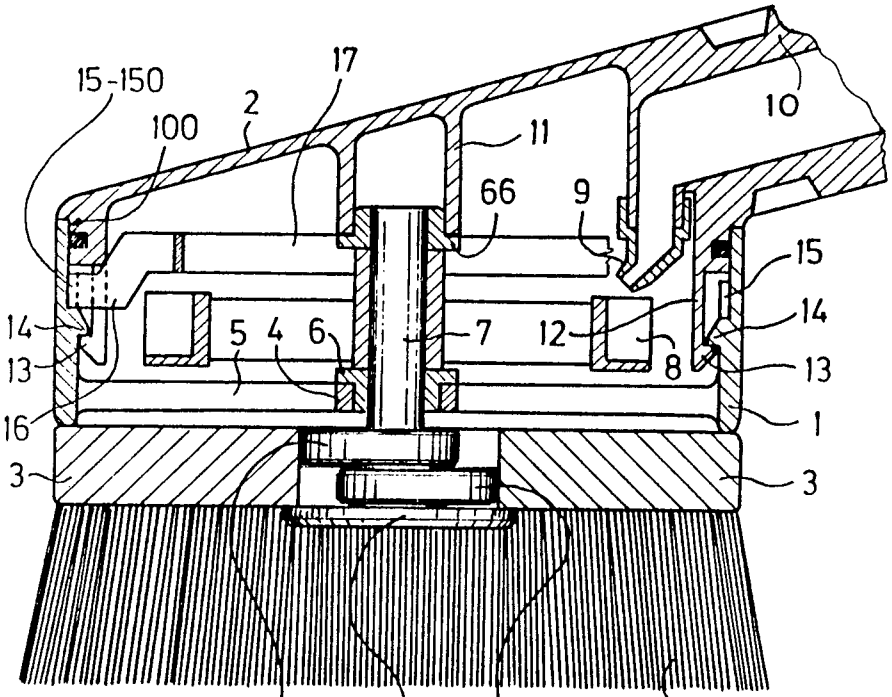
FIG. 1 is a section on the line I—I of FIG. 2, showing a first embodiment of the invention.
Figure 2:
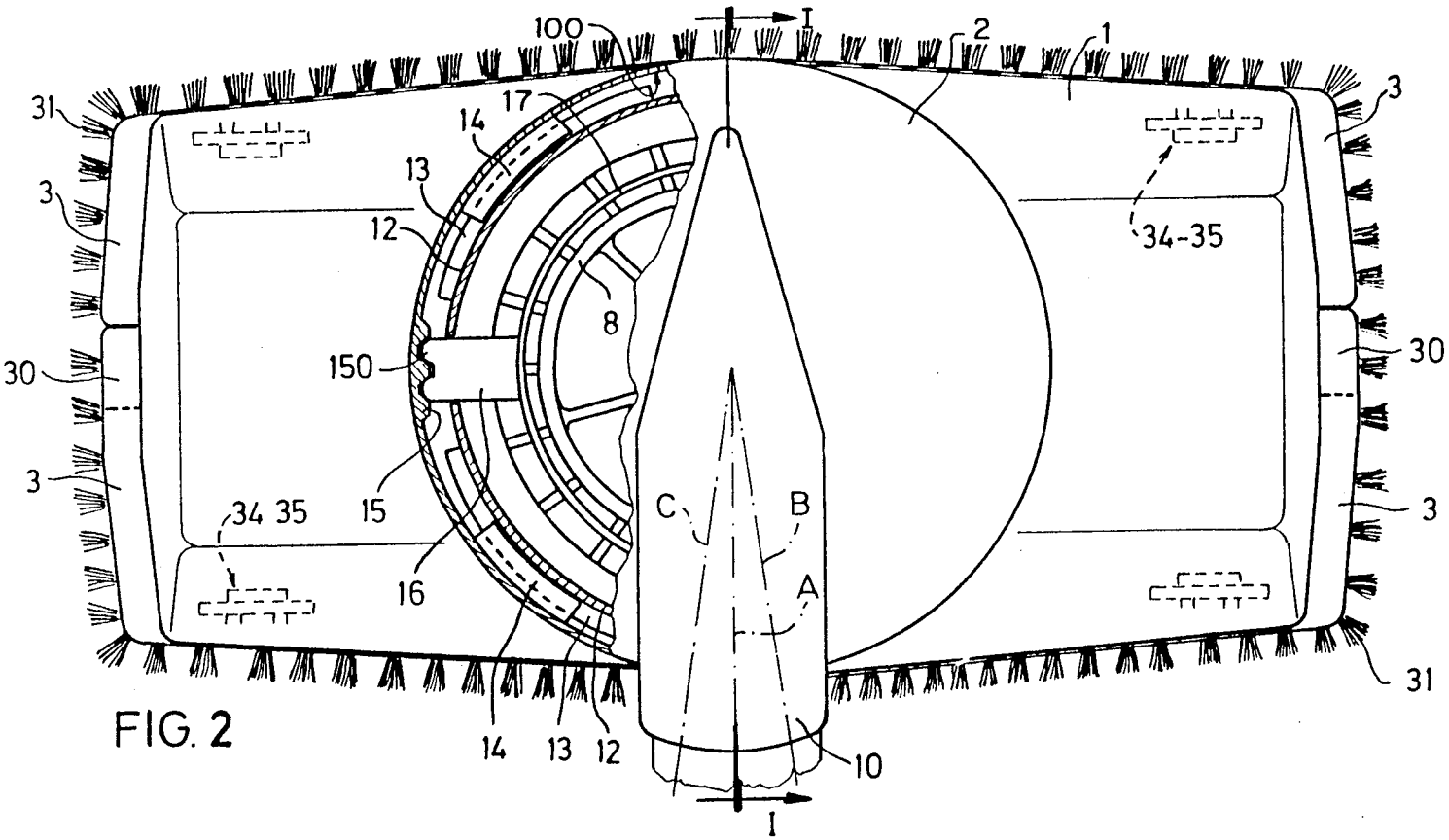
FIG. 2 is a view from above of the preceding figure, with parts cut away to better illustrate parts which would otherwise be hidden.

The figures, and in particular FIGS. 1 and 2, show a casing comprising a hollow body 1 of substantially rectangular plan (FIG. 2), which is provided at its top with a central circular aperture 100 sealedly closed by a removable cover 2, its lower mouth being occupied by two side-by-side coplanar plates 3 (see FIG. 1) reciprocatingly slidable in phase opposition, as will be apparent hereinafter. The plates 3 (or slide blocks) are of elongate form with their longitudinal axes parallel to that of the body 1, and are arranged to slide parallel to their axes. In the lower part of the body 1 there is provided, supported by a series of spokes 5, a central vertical cylindrical support 4 in which a shaft 7 is rotatably mounted by way of a bush 6.

On this shaft there is fixed a bladed impeller, indicated by 8, tangentially to which there is provided a wash water feed nozzle 9. The nozzle 9 is connected to an inclined inlet pipe stub 10 provided above and to the side of the cover 2 (see FIG. 1) and disposed radially to it (FIG. 2). Said pipe stub 10 is arranged to be connected to a hollow handgrip, such as a handle, which is itself intended to be connected to a convenient source of pressurized water, such as the main water supply.

As can be seen in FIG. 1, the bush 6 cooperates with an overlying bush 66, which is mounted on the top of the shaft 7, and is inserted into a hollow cylindrical stem 11 projecting from the cover 2. This latter extends into the hollow body 1 by means of a skirt 12, which is peripherally provided with four equidistant outer lower teeth 13. Correspondingly, the circular aperture 100 of the body 1 comprises four equidistant small projecting lips 14, under which said teeth 13 are fixed by rotating the cover 2 relative to the body 1. It should be noted that by virtue of the described fixing means, the pipe stub 10 and hence the corresponding handgrip can be positioned either as shown by full lines in FIG. 2, i.e. orthogonal to the direction of travel of the plates 3, or perpendicular to the illustrated position, i.e. parallel to said travel direction. This is for the reason stated in the introduction.

With reference to FIGS. 1 and 2, above said fixing lips 14 (FIG. 1) there are provided corresponding toothed sectors 15 with which respective teeth 150 engage when the cover 2 is fixed in position. These teeth are provided on the facing ends of corresponding shaped arms 16 (FIG. 1) branching from a thin ring 17, this latter being located above the impeller 8.

The ring 17 and/or the arms 16 are elastically deformable, these latter being inserted through corresponding apertures provided in the skirt 12 (FIGS. 1, 2). By virtue of the toothed sectors and teeth 150, once the cover 2 has been locked onto the body 1 in one of the aforestated positions, the cover 2 and hence the handgrip can be swivelled from one side to the other of the central locking position indicated by A in FIG. 2.

The two further positions B and C (see FIG. 2), which straddle the central position A, obviously increase the applicability of the invention.

In the illustrated example the three positions A, B, C, defined by the toothed engagement 15–150, are angularly spaced apart by about 4', but the angle can be different. Further positions can also be made available by simply increasing the number of teeth 150.

Figure 4:
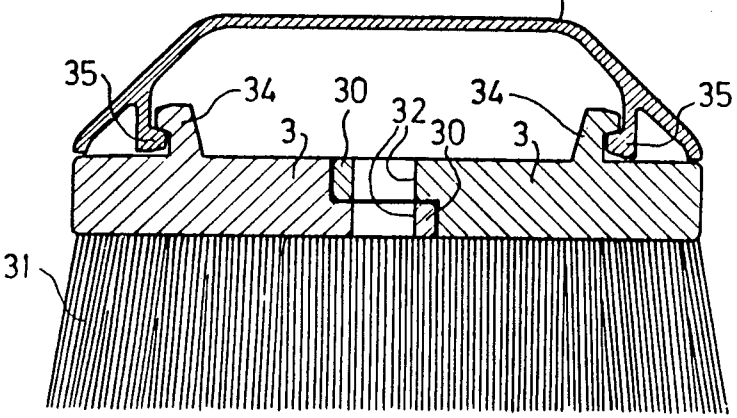
FIG. 4 is a section on the line IV—IV of FIG. 3.

As can be seen in FIGS. 3 and 4, the facing edges of the two side-by-side plates 3 comprise two overlying ledges 30 each provided with a central transverse seat 33 open towards the free end of the corresponding ledge 30.

The two seats 33 house two off-centre discs 70 provided on the shaft 7 and have diametrically opposite eccentricity, so that the two plates 3 are driven with reciprocating rectilinear motion in phase opposition.

Tufts of cleaning bristles 31 are fixed in known manner to the underside of the plates 3, to receive the water falling from above, via a series of passages 32 provided in the ledges 30 and in the plates (FIG. 3).

It should be noted that the lower aperture of the hollow body 1 is constantly closed by the two plates 3, so that all the wash water reaches the mass of bristles 31.

Finally, as can be seen in FIG. 1, the two plates 3 are supported from beneath by a widened head 77 rigid with the shaft 7. Each plate 3 is provided with two opposing lateral support/sliding elements 34 (see FIGS. 3 and 4).

Each element 34 extends parallel to the longitudinal axis of the plates 3 (or to their travel direction) and is of right-angled cross-section (FIG. 4), under the horizontal arm of which there snap-engages an elastic profiled tongue 35 extending from the hollow body 1.

As stated heretofore, the described construction represents only one of the preferred embodiments. In this respect, instead of consisting of the two plates 3, the cleaning member can consist of only one plate (see FIG. 6A) made to slide forwards and backwards in a direction transverse (perpendicular) to the shaft 7. Again, the cleaning member can consist of two coplanar plates arranged one in front of the other (see FIG. 6D) rather than side by side as in FIGS. 3 and 6B, so that they slide forwards and backwards with a mutual approach and withdrawal reciprocating motion.

Figure 6E:
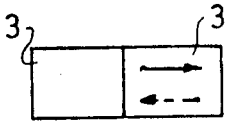
FIGS. 6A–6E are schematic views from above showing different embodiments of the cleaning member according to the invention.
Figure 6D:
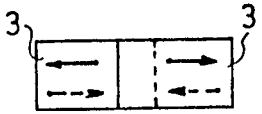
Figure 6C:
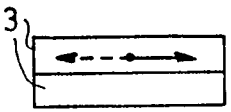
Figure 6B:
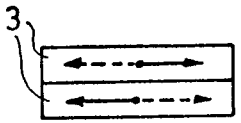
Figure 6A:
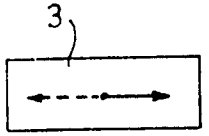

Finally, it should be noted that if the cleaning member consists of two plates disposed side by side or frontally as stated, it is also possible for only one of them to be driven with reciprocating rectilinear motion, the other remaining stationary, as shown in FIGS. 6C and 6E.

These considerations are also valid for the embodiment shown in FIG. 5, in which the elements corresponding to those described with reference to FIGS. 1 to 4 carry the same reference numerals for simplicity. As can be seen in FIG. 5, in this further alternative embodiment the off-centre discs 70 and the head 77 pertain to an element fixed to the base of the shaft 7 by a coaxial screw 71.

In addition the bladed impeller 8 is provided with a cup-shaped socket 80 for containing a speed reduction gear unit.

The unit comprises a gear 81 provided on the hub 82 of the impeller 8, the hub 82 being idly mounted on the shaft 7.

The gear 81 engages a gear of larger diameter pertaining to a double gear 83, the other (upper) gear of which is of smaller diameter than the preceding (lower) and engages a larger diameter gear 84 fixed onto the top of the shaft 7. Finally, although not shown, on the inner surface of the body 1 there is provided a plurality of circumferentially equidistant inclined ribs arranged to guide the water stream discharged by the impeller towards the plates 3.

The merits and advantages of the invention are apparent from the aforegoing and from an examination of the accompanying figures.

The invention is not limited to the embodiments illustrated and described, but covers all technical equivalents of the aforesaid means and their combinations, if implemented within the context of the following claims.

For example cranks can be provided instead of the eccentric discs 70.

We claim:

1. A brush for general surface cleaning, operated by the actual wash water comprising a casing having a lower base, a shaft rotatably mounted in said casing, a bladed impeller fixed to said shaft.

nozzle means located in said casing and positioned to direct wash water tangentially with respect to said bladed impeller, cleaning means provided at said lower base of said casing for utilizing wash water which flows thereto, said cleaning means including at least one plate arranged transversely to said shaft, said plate being provided with a mass of bristles on a lower surface, means carried by said shaft to give said plate reciprocating rectilinear movement transversely to said shaft, said casing comprising a hollow body which is sealedly closed by a removable upper central cover, said nozzle being supported by said upper central cover, a handgrip extends upwardly and outwardly from said upper central cover, and means for angular positioning of said upper central cover on said hollow body in at least two mutually orthogonal angular positions in which said handgrip is disposed respectively perpendicular and parallel to the travel direction of said plates.

2. A brush as claimed in claim 1 wherein said means for angular positioning of the cover relative to the hollow body includes downwardly projecting fixing teeth carried by said cover which when the cover is rotated engage below lips projecting from the hollow body.

3. A brush as claimed in claim 1, wherein said hollow body comprises a series of inwardly facing toothed sectors with which there correspond respective teeth provided at the ends of elastically deformable arms associated with carried by said cover, said toothed sectors and teeth providing means for selecting, by rotating the cover relative to the hollow body, angular positions of the cover which are different from said two mutually orthogonal positions.

4. A brush for general surface cleaning, operated by the actual wash water, comprising:

a casing having a lower mouth, a shaft rotatably housed in said casing, a bladed impeller fixed to said shaft, nozzle means located in said casing and positioned to direct wash water tangentially with respect to said bladed impeller, means for cleaning comprising two plates, each of said plates having a lower side from which a mass of bristles extend, means slidably coupling each of said plates to said casing for reciprocal sliding with rectilinear reciprocating movement transversely to said shaft, said plates having facing edges in sliding engagement with each other and being located and dimensioned to close said mouth of said casing, and cam means, including two cam devices carried by said shaft, for causing said plates to move with rectilinear movement with respect to the casing and in phase opposition with respect to each other.

5. a brush according to claim 4, wherein each of said cam devices comprises an off-centre disc provided on said shaft, each of said cam discs is housed in a corresponding seat provided in a facing edge of a respective plate, and said cam discs have diametrically opposite eccentricity with respect to each other.

6. A brush according to claim 5 wherein each of said facing edges has a ledge extending therefrom, said ledges being in overlying relationship and each ledge being provided with one of said seats, said means slidably coupling each of said plates to said casing for reciprocal sliding including sliding elements affixed to each of said plates, and a widened head means rigid with a lower end of said shaft for supporting said plates from beneath.

7. A brush according to the claim 4, wherein each of said plates is provided with a series of passages arranged to direct water discharged by said impeller toward said bristles.

* * * * *